US005772135A

United States Patent [19]

Styles

[11] Patent Number: 5,772,135

[45] Date of Patent: Jun. 30, 1998

[54] JAW CRUSHERS

[75] Inventor: Kenneth Thomas Styles, Mt. Waverley, Australia

[73] Assignee: Clyde Industries Limited, Richmond, Australia

[21] Appl. No.: 737,898

[22] PCT Filed: Apr. 27, 1995

[86] PCT No.: PCT/AU95/00253

§ 371 Date: Feb. 24, 1997

§ 102(e) Date: Feb. 24, 1997

[87] PCT Pub. No.: WO95/31286

PCT Pub. Date: Nov. 23, 1995

[30] Foreign Application Priority Data

May 12, 1994 [AU] Australia ..... PM5599

[51] Int. Cl.[6] ..... B02C 1/10

[52] U.S. Cl. ..... 241/264; 241/291; 241/300

[58] Field of Search ..... 241/198.1, 262, 241/264, 291, 300

[56] References Cited

U.S. PATENT DOCUMENTS

| | | | |
|---|---|---|---|
| 1,400,257 | 12/1921 | Bechgaard . | |
| 2,122,033 | 6/1938 | Hallenbeck | 241/264 |
| 2,758,794 | 8/1956 | Roubal . | |
| 2,950,871 | 8/1960 | Smith | 241/291 X |
| 3,140,057 | 7/1964 | Pollitz | 241/291 X |
| 3,144,214 | 8/1964 | Perdue . | |
| 3,527,420 | 9/1970 | Maurer | 241/291 X |
| 3,804,345 | 4/1974 | DeDiemar . | |
| 3,984,058 | 10/1976 | Archer et al. | 241/264 |

FOREIGN PATENT DOCUMENTS

| | | |
|---|---|---|
| 2397625 | 7/1925 | Australia . |
| 269400 | 9/1967 | Australia . |

*Primary Examiner*—John M. Husar

*Attorney, Agent, or Firm*—Knobbe, Martens, Olson & Bear, LLP

[57] ABSTRACT

A replaceable jaw face (10*a*–10*d*) for a jaw crusher for crushing rocks and the like comprises corrugations (c) the axes of which are inclined to the vertical such that there is a lateral phase shift of the corrugations between the upper and lower end edges (16,18) of the face. This configuration provides interchangeability of the jaw faces throughout the jaws of the crusher while maintaining the correct relationship between the corrugations of the jaw faces of the opposing jaws.

6 Claims, 3 Drawing Sheets

JAW CRUSHERS

The present invention relates to jaw crushers for crushing rocks and other mineral matter, and more particularly to replaceable jaw faces for jaw crushers.

Jaw crushers for crushing rock and other minerals conventionally comprise a fixed jaw and a movable jaw which define a crushing chamber of a cross section which narrows from top to bottom. The movable jaw is pivotally supported at its upper end so that the lower end of the jaw can be driven in a swinging motion towards and away from the lower end of the fixed jaw. Material to be crushed is introduced into the upper end of the crushing chamber formed between the two jaws and is crushed between the two jaws by the swinging movement of the movable jaw as the material moves downwardly through the chamber, the crushed material being discharged from the chamber at its lower end. The crushing surfaces of the two jaws are subject to substantial wear and are conventionally formed by replaceable faces which are fixed to the body of the jaw by being bolted and keyed. Usually, to facilitate breakage of the rock the surface of each replaceable jaw face is corrugated, with the axes of the corrugations extending in a vertical direction and normally each jaw carries two separate jaw faces, namely an upper face and lower face. The primary effect of the corrugations is achieved at the lower, narrow, end of the crushing chamber, and in order to generate the necessary breaking forces the opposed jaw faces of the two jaws are so arranged that the peaks of the corrugations of one of the jaw faces align with the troughs of the corrugations of the other jaw face. As a result of this, with conventional jaw faces there is limited scope for interchangeability of the various jaw faces to compensate for wear, most of which occurs at the lower end of the crushing chamber; for example with conventional jaw faces the upper and lower jaw faces or each jaw could be interchanged but there is not complete flexibility to interchange the four jaw faces while retaining the required relationship between the sets of corrugations.

According to the present invention, there is provided a replaceable jaw face for a jaw crusher, the jaw face having corrugations the axes of which extend along the height of the jaw face, wherein the axes of the corrugations are inclined to the vertical such that there is a lateral phase shift of approximately 90° (or an odd number multiple thereof) of the corrugations between the upper and lower end edges of the face whereby when two such jaw faces are placed in opposed relationship on the opposite jaws of a jaw crusher with the lower end edges of the respective faces at the lower end of the crushing chamber of the crusher, the opposed corrugations will, in the zone of the lower end exhibit a phase relationship wherein the peaks of the corrugations of one of the faces will substantially align with the troughs of the corrugations of the other face.

In a preferred embodiment, the phase shift between the upper and lower end edges of the said face is slightly more than 90° so that precise matching of the peaks and troughs of the opposed corrugations of the two opposed jaw faces will occur at a position adjacent to, but above, the lower ends of the two jaw faces.

In a preferred embodiment, two identical jaw faces as defined above are mounted on each jaw as a lower and upper jaw face, the upper jaw face being formed by 180° inversion of the jaw face, and the corrugations at the end edge of the jaw face which is to lie at an intermediate position along the height of the jaw are such that when the end edges of the upper and lower jaw faces are in abutting relation the corrugations of the lower jaw face will form a direct continuation of the corrugations of the upper jaw face.

According to another aspect of the invention, there is provided a jaw crusher having fixed and movable jaws and identical jaw faces as defined above mounted to the jaws. Preferably four such jaw faces are used to form upper and lower jaw faces of the two jaw.

An embodiment of the invention will now be described, by way of example only, with reference to the accompanying drawings, in which.

Figure 1:
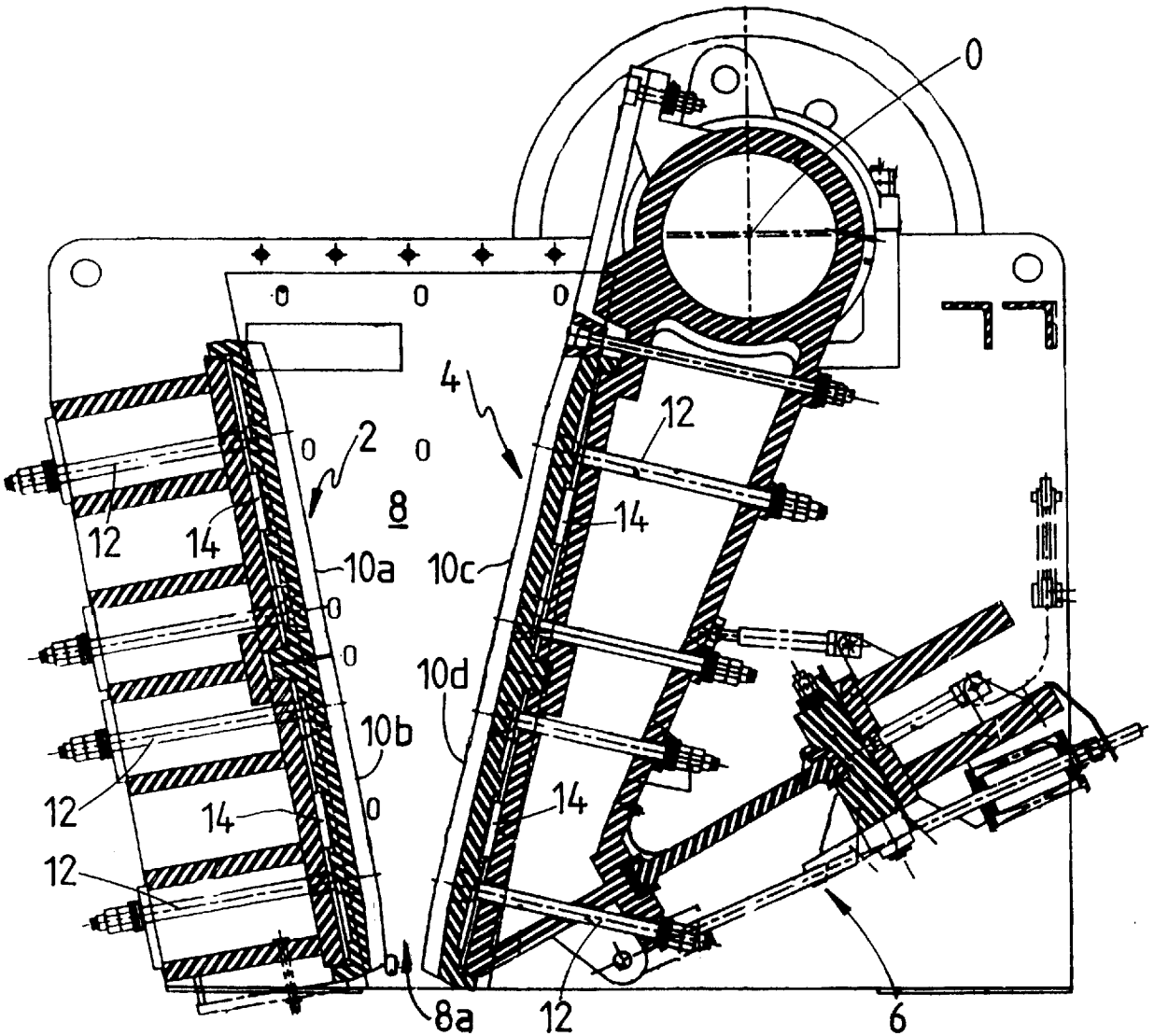
FIG. 1 is a vertical section through a jaw crusher and showing a movable jaw and a fixed jaw of the crusher.

There is shown in FIG. 1 a cross section of a jaw crusher which, apart from the design of the corrugations of the jaw faces, is of otherwise substantially conventional construction. The fixed jaw is shown at 2 and the movable jaw at 4, the movable jaw 4 being mounted to swing about a pivot axis 0 at its upper end, and its lower end is coupled to a drive mechanism generally denoted by 6 to cause swinging movement about the pivot axis 0. A progressively-narrowing crushing chamber, defined between the jaws 2, 4, is shown at 8, with the crushed material being discharged through its lower end 8*a*. Each jaw 2,4 carries separate upper and lower removable jaw faces 10*a* to 10*d*, one mounted above the other. The jaw faces 10 are retained against the body of the respective jaw 2,4 by bolts shown at 12 and keys shown at 14, although suitable fixing means may alternatively be used.

Figure 2:
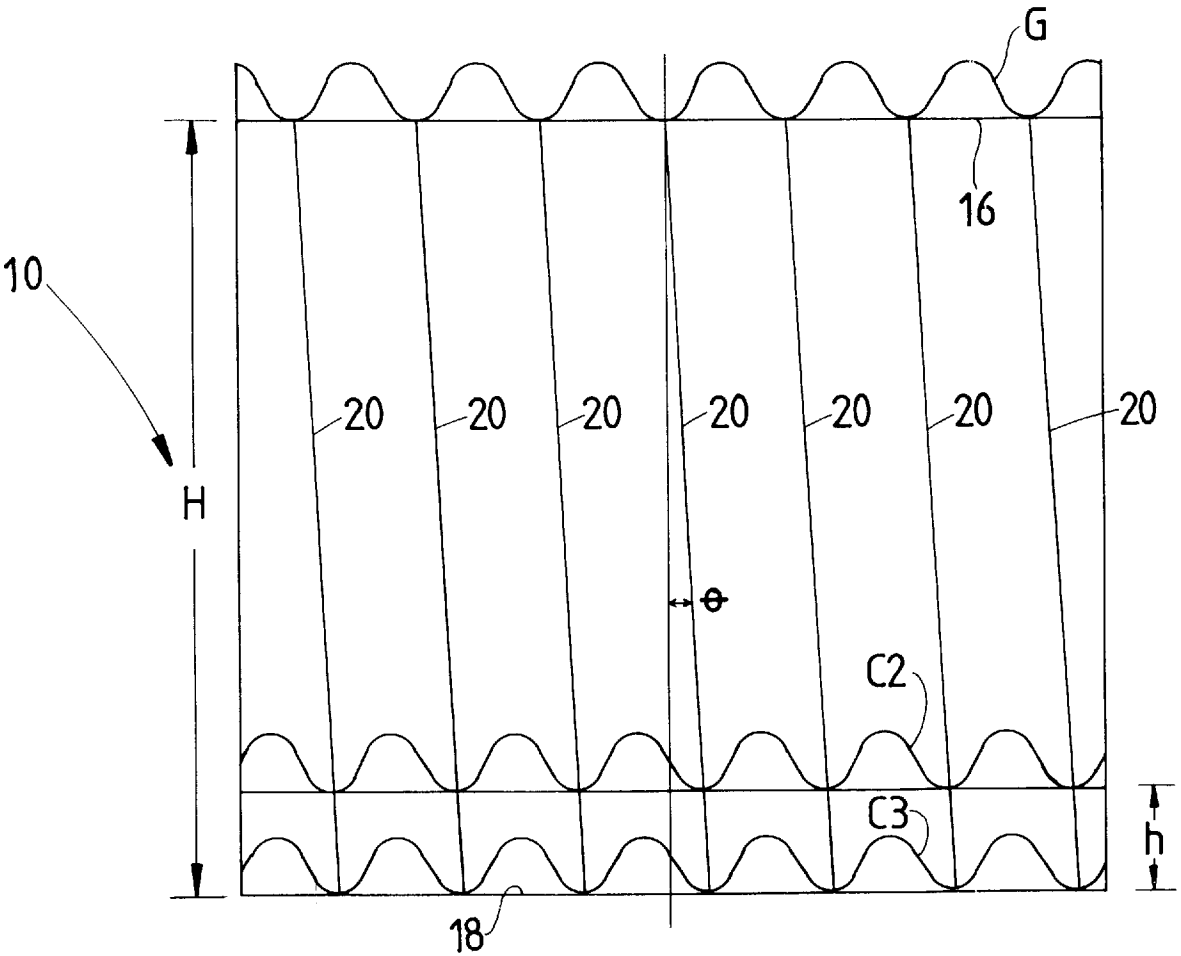
FIG. 2 is a front view of one jaw face of the crusher.

The four jaw faces 10*a* to 10*d* are each of identical construction, each face being rectangular with parallel corrugations C extending along the height direction of the face. The configuration of the corrugations is such that each jaw face can be mounted in any one of the four positions on the jaws 2,4 while maintaining the same relationship between the peaks and troughs of the corrugations of the jaw faces of the two jaws. The jaw face shown in FIG. 2 is orientated in the position it will assume when used as a lower jaw face and when used as an upper jaw face it is turned through 180° from the position illustrated. For the sake of convenience, the upper end edge 16 shown in FIG. 2 (and which will be the lower end edge when the face is turned through 180° and used as an upper jaw face) will be termed as the "inner end edge" and the opposite end edge 18 will be termed as the "outer end edge". In FIG. 2, for the purposes of explanation, the cross-sectional form of the corrugations C is superimposed onto the drawing. At the inner end edge 16 the corrugations ($C_1$) are so arranged as to extend through a multiplicity of complete pitches from one side of the face to the other so that when the inner end edges 16 of identical upper and lower jaw faces are in abutting relation the corrugations of the upper and lower jaw faces will be in precise phase alignment and will continue smoothly from the upper jaw face to the lower jaw face (see FIG. 3). However, the axes 20 of the corrugations C do not extend vertically along the jaw face but are, instead, inclined to the vertical by an angle θ. The inclination is such that at the outer end edge 18 the corrugations ($C_3$) have a lateral phase shift of approximately one quarter pitch (90°) in relation to the phase of the corrugations $C_1$ at the inner end edge 16. Accordingly, when a jaw face of this form is used as the lower jaw face for each of the two jaws 2,4, the opposed corrugations of the two lower jaw faces will, at their lower end edges, adopt a lateral phase shift one relative to the other of approximately one half pitch (180°) whereby at that position the troughs of one set of corrugations will approximately align with the peaks of the other set in order to provide the required relationship between the two sets of corrugations at the lower end of the crushing chamber 8.

As will be apparent, due to the inclination θ which results in the lateral phase shift at the lower end of the two lower jaw faces, the two opposed sets of corrugations when mounted on the jaws 2,4 in facing relation will not be "parallel" (that is inclined in the same direction), but instead will be inclined in opposite directions so that the axes 20 of the opposed sets of corrugations incline one relative to the other at an angle of 2θ. Accordingly, the precise 180° phase relationship between the two opposed sets of corrugations to provide matching peaks and troughs cannot occur throughout the length of the sets of corrugations, but only at one point. The absence of the correct phase relationship between the opposed sets of corrugations is of no concern in the upper part of each jaw face as the correct phase relationship is only needed at the lower end at the exit end of the crushing chamber 8. We have determined that it is desirable for the precise 180° phase relationship of the opposed sets of corrugations to be achieved not exactly at the lower end edges 18 of the opposed jaw faces, but at a position a little above the lower end edge. By this means, a substantially correct phase relationship can be obtained over a distance below and above the exact point of precise phase relationship and, in practice, this will be sufficient. By way of example, for a jaw face of a height H, the phase shift between the inner and outer end edges 16,18 will be a little more than one quarter pitch (90°) such that the precise quarter pitch (90°) phase shift of the corrugations (see $C_2$) occurs at a distance h of approximately 0.10H to 0.5H inwardly from the outer end edge 18. Although the angle of inclination θ necessary to effect the quarter phase (90°) phase displacement will be dependent on the height H of the jaw face and the pitch of the corrugations, in most instances, the necessary phase shift can be achieved with an inclination θ of only a few degrees (typically 2° to 3°) so that there will exist an appropriate mating relationship between the opposed peaks and troughs not only at the precise point of 180° phase relationship but also beneath that as far as the lower end edge 18 and for a distance above that point.

As described above, the required relationship is obtained by a one quarter pitch (90°) phase shift of the corrugations from the inner end edge of the jaw face to the outer end edge. In principle, a similar effect could be obtained by phase shifts of higher odd number multiples of 90°, for example 270°. This will, of course, result in an increased angle of inclination θ over that needed to achieve the one quarter pitch phase shift and hence a reduction in the overall length over which a satisfactory trough to peak relationship can be obtained, but nevertheless such a configuration could be feasible for jaw faces which are relatively long and where the pitch of the corrugations is relatively small.

Figure 3:
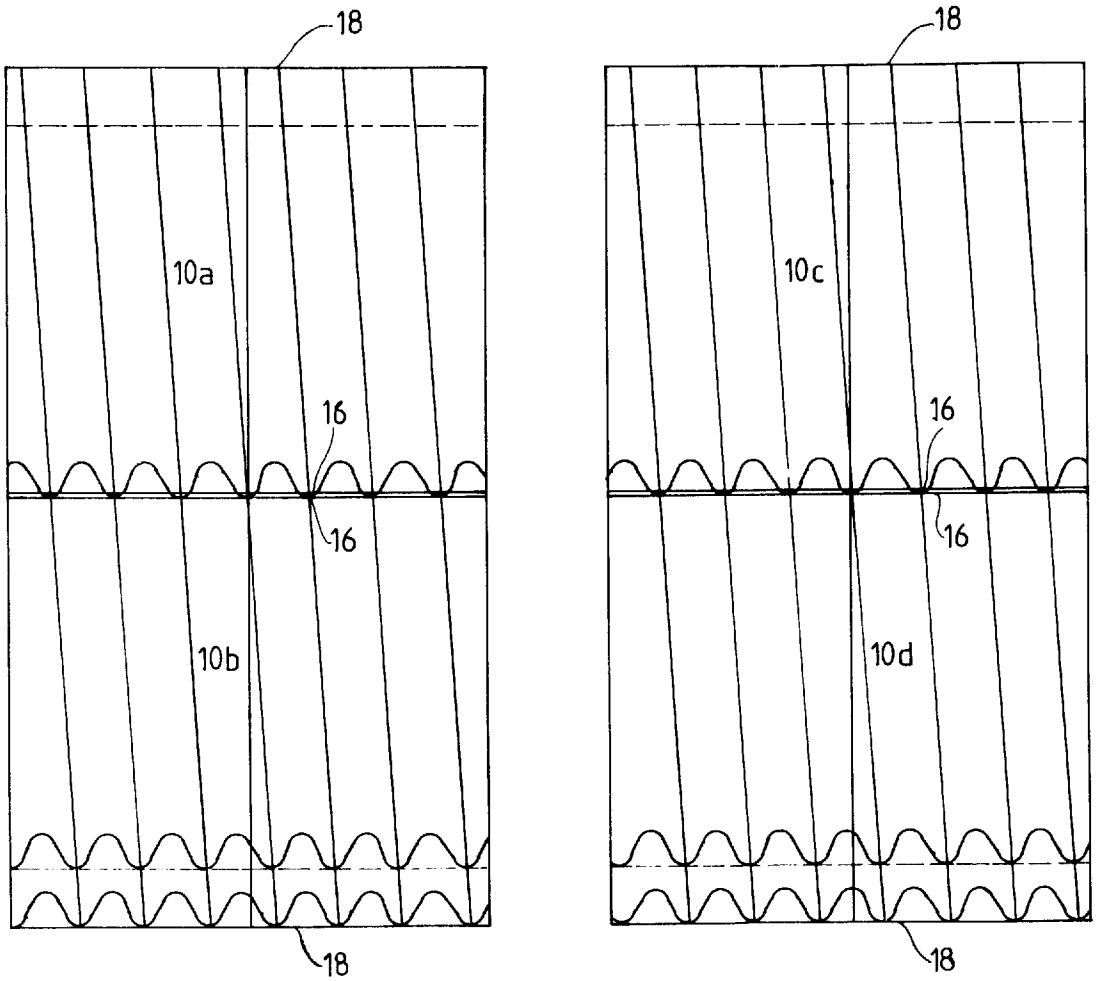
FIG. 3 shows the manner in which four of the jaw faces shown in FIG. 2 are assembled onto the fixed and movable jaws of the jaw crusher.

By use of a jaw face as described herein, only one design of jaw face needs to be produced. That jaw face can be used in conjunction with other identical jaw faces in any one of the four positions as illustrated in FIG. 3. When mounted on each jaw, the corrugations of the upper and lower jaw faces will align precisely and will continue smoothly one into the other at the abutting inner end edges 16 of the two faces. The four jaw faces can be interchanged to any position within the crushing machine to equalise the wear of the respective faces.

Although a typical jaw crusher will have jaws of a size which carry two jaw faces on each jaw, smaller jaw crushers may only carry a single jaw face on each jaw, and larger jaw crushers may carry three (or more) jaw faces on each jaw. A jaw face in accordance with the principles of the invention as described herein can be used in each of these situations.

The embodiment has been described by way of example only and modifications are possible within the scope of the invention.

I claim:

1. A replaceable jaw face for a jaw crusher, the jaw face having corrugations the axes of which extend along the height of the jaw face, wherein the axes of the corrugations are inclined to the vertical such that there is a lateral phase shift of approximately 90° or an odd number thereof of the corrugations between upper and lower end edges of the face whereby when two such jaw faces are placed in opposed relationship on opposite jaws of a jaw crusher with lower end edges of the respective faces at a lower end of a crushing chamber of the crusher, the opposed corrugations will, in the zone of the lower end, exhibit a phase relationship wherein peaks of the corrugations of one of the faces will substantially align with troughs of the corrugations of the other face.

2. A replaceable jaw face according to claim 1, wherein the phase shift between the upper and lower end edges of the face is slightly more than 90° or an odd number multiple thereof so that precise alignment of the peaks and troughs of the opposed corrugations of the two opposed jaw faces will occur at a position adjacent to, but above, the lower ends of the two jaw faces.

3. A replaceable jaw face according to claim 2, wherein the configuration of the jaw face is such that two identical such jaw faces can be mounted on each jaw of said jaw crusher as a lower and upper jaw face, the upper jaw face being formed by 180° inversion of the lower jaw face, and the corrugations at that end edge of the jaw face which is to lie at an intermediate position along the height of the jaw are such that when the end edges of the upper and lower jaw faces are in abutting relation the corrugations of the lower jaw face will form a direct continuation of the corrugations of the upper jaw face.

4. A replaceable jaw face according to claim 1, wherein the configuration of the jaw face is such that two identical such jaw faces can be mounted on each jaw of said jaw crusher as a lower and upper jaw face, the upper jaw face being formed by 180° inversion of the lower jaw face, and the corrugations at that end edge of the jaw face which is to lie at an intermediate position along the height of the jaw are such that when the end edges of the upper and lower jaw faces are in abutting relation the corrugations of the lower jaw face will form a direct continuation of the corrugations of the upper jaw face.

5. A replaceable jaw face according to claim 1, wherein the inclination of the axes of the corrugations to the vertical is only a few degrees.

6. A jaw crusher for crushing rocks and other mineral matter, said crusher comprising a fixed jaw and a movable jaw defining a crushing chamber of a cross-section which narrows from top to bottom, means for driving the movable jaw relative to the fixed jaw to provide a cutting action, and identical jaw faces mounted to the jaws, each face having corrugations the axes of which extend along the height of the jaw face, wherein the axes of the corrugations are inclined to the vertical such that there is a lateral phase shift of approximately an odd number multiple of 90° of the corrugations between upper and lower end edges of the face whereby when two such jaw faces are placed in opposed relationship on the fixed and movable jaws of the jaw crusher with lower end edges of the respective faces at a lower end of the crushing chamber, the opposed corrugations in the lower end will exhibit a phase relationship wherein peaks of the corrugations of one of the faces will substantially align with troughs of the corrugations of the other face.

* * * * *